US009347405B2

(12) United States Patent
Jung

(10) Patent No.: US 9,347,405 B2
(45) Date of Patent: May 24, 2016

(54) ENVIRONMENTALLY FRIENDLY FUEL ACTIVATION DEVICE

(76) Inventor: In bum Jung, Gyunggido (KR)

( * ) Notice: Subject to any disclaimer, the term of this patent is extended or adjusted under 35 U.S.C. 154(b) by 1092 days.

(21) Appl. No.: 13/379,071

(22) PCT Filed: Jun. 18, 2010

(86) PCT No.: PCT/KR2010/003940
§ 371 (c)(1),
(2), (4) Date: Dec. 19, 2011

(87) PCT Pub. No.: WO2010/147422
PCT Pub. Date: Dec. 23, 2010

(65) Prior Publication Data

US 2012/0145809 A1 Jun. 14, 2012

(30) Foreign Application Priority Data

Jun. 18, 2009 (KR) ..... 10-2009-0054615
Jun. 18, 2009 (KR) ..... 10-2009-0054620

(51) Int. Cl.
*B05B 7/00* (2006.01)
*F02M 27/08* (2006.01)

(52) U.S. Cl.
CPC ..... *F02M 27/08* (2013.01)

(58) Field of Classification Search
CPC .... F02M 27/045; F02M 27/047; F02M 27/08
USPC ..... 239/4, DIG. 11, 88, 89, 90, 91, 92, 584, 239/585.1–585.5, 398, 399, 301, 306; 123/298, 301, 306; 210/222, 223
See application file for complete search history.

(56) References Cited

U.S. PATENT DOCUMENTS 4,118,797 A * 10/1978 Tarpley, Jr. ..... 366/127
4,875,951 A * 10/1989 Prest et al. ..... 149/109.6

(Continued)

FOREIGN PATENT DOCUMENTS

JP 06-173777 1/2000
JP 08-200162 1/2000

(Continued)

OTHER PUBLICATIONS

International Search Report for PCT/KR2010/003940 mailed Mar. 31, 2011.

*Primary Examiner* — Arthur O Hall
*Assistant Examiner* — Viet Le
(74) *Attorney, Agent, or Firm* — STIP Law Group, LLC

(57) ABSTRACT

The present invention relates to an environmentally friendly fuel activation device in which the fuel and water are atomized into atomized fuel particles, following attenuation of their cohesive force, to allow smooth mixing with oxygen, which improves combustion efficiency and reduces fuel costs, and more specifically comprises a water-supply tube joined to a first valve and a fuel-supply tube joined to a second valve which are coupled to a supply tube; a first case and a second case as well as a coupling piece coupling the first and second cases; and the inside of the first case is provided with a first rotating atomizing piece, an accelerating piece and a second rotating atomizing piece, while the inside of the second case is provided with a first rotating atomizing tube, a first non-rotating atomizing tube, a second rotating atomizing tube, a second non-rotating atomizing tube, a third rotating atomizing tube and a third non-rotating atomizing tube. Fuel and water are supplied simultaneously while oxygen and hydrogen resulting from broken down water activate the fuel, which improves combustion efficiency and reduces fuel costs.

1 Claim, 14 Drawing Sheets

(56) References Cited

U.S. PATENT DOCUMENTS

| | | | | |
|---|---|---|---|---|
| 5,443,183 | A * | 8/1995 | Jacobsen et al. | 222/145.6 |
| 5,679,236 | A * | 10/1997 | Poschl | 205/351 |
| 2003/0168393 | A1* | 9/2003 | Tsunematsu | 210/222 |
| 2006/0213124 | A1* | 9/2006 | Maruchi | 48/61 |
| 2007/0209643 | A1* | 9/2007 | Lu | 123/538 |

FOREIGN PATENT DOCUMENTS

| | | |
|---|---|---|
| KR | 10-2003-0000167 | 1/2000 |
| KR | 10-0748233 | 1/2000 |
| KR | 10-0787779 | 1/2000 |

* cited by examiner $$\dot{F}_d = \dot{F}\frac{\dot{v}_1}{\dot{v}_0} + (-\dot{F}) \cdot \left(\frac{-\dot{v}_2}{-\dot{v}_0}\right) \cdot \left(\frac{-\dot{v}_0}{\dot{v}_0}\right)$$

$$= \dot{F}\frac{1}{\dot{v}_0}(\dot{v}_1 + \dot{v}_2)$$

$$\therefore W = \frac{F \cdot d}{F} = \frac{1}{\dot{v}_0}(\dot{v}_1 + \dot{v}_2)$$

ENVIRONMENTALLY FRIENDLY FUEL ACTIVATION DEVICE

RELATED APPLICATIONS

This application is a 371 application of International Application No. PCT/KR2010/003940, filed Jun. 18, 2010, which in turn claims priority from Korean Patent Application Nos. 10-2009-0054620, filed Jun. 18, 2009, and 10-2009-0054615, filed Jun. 18, 2009, each of which is incorporated herein by reference in its entirety.

TECHNICAL FIELD

The present invention relates to an environmentally friendly fuel activation device, and in particular to an environmentally friendly fuel activation device in which fuel and water is atomized into atomized particles, following attenuation of their cohesive force, to obtain a smooth mixing with oxygen, which consequently improves combustion efficiency and reduces fuel costs.

BACKGROUND ART

Combustion efficiency might be generally improved in such a way that a compression, ignition and then explosion are designed to occur in a state that a physical performance is improved following a pretreatment process of fluid such as fuel oil or the like, the processes of which are called a fuel oil pretreatment process, thus enhancing fuel efficiency. Air pollution occurring owing to incomplete combustion can be significantly reduced.

A typical example of the conventional fuel saving device is shown in FIG. 1.

As shown therein, the conventional fuel saving device comprises a first case 1 with a fuel inlet 1*a* at one side and a hollow part 1*b;* a second case 2 with a fuel outlet 2*a* at one side and a hollow part 2*b;* a connection part 3 interconnecting the first case 1 and the second case 2 and with a spray hole 3*a* at its central portion;

a first rotation atomizing part 4 which is disposed in vicinity of the fuel inlet 1*a* of the first case 1 and has a spiral groove 4*a* along its outer circumferential surface in a longitudinal direction;

an acceleration part 5 which is in close contact with the first rotation atomizing part 4 and has a spray hole 5*a* at its central portion;

a second rotation atomizing part 6 which is disposed in close contact with the acceleration part 5 and has a spiral groove 6*a* on its circumferential surface in a longitudinal direction; and three rotation atomizing tubes 7, 8, and 9 which are disposed at a hollow part 2*b* of the second case 2, respectively, and has spiral rotation protrusions 7*a*, 8*a* and 9*a* in their outer circumferential surfaces in a rotation direction, and three no-rotation atomizing tubes 7', 8' and 9' which pass through and cover the outer surfaces of the rotation atomizing tubes 7, 8 and 9 and have straight rotation protrusions 7'*a*, 8'*a* and 9' a on their outer circumferential surfaces in the rotation direction.

The above conventional fuel saving device is characterized in that fuel is inputted into a fuel inlet 1*a* of the first case 1, and flows along the spiral groove 4*a* through a concave groove part of the first rotation atomizing part 4 and continues to flow and then makes turbulence at the concave groove of the first rotation atomizing part 4, thus accelerating its own flow speed, and continues to flow along the spiral groove 4*a*.

Here, while the fuel continues to flow along the spiral groove 4*a*, the first rotation part 4 rotates in an axial direction, which leads to atomizing fuel into atomized particles with the aid of the axial rotations.

The fuel which has passes through the first rotation atomizing part 4 is accelerated and sprays toward the second rotation atomizing part 6 through the spray holes 5*a* of the acceleration part 5 and keeps flowing along the spiral groove 6*a*. Here, the fuel makes turbulence at a concave groove and is reaccelerated and then flows along the spiral groove 6*a* and is finally guided to the spray holes 3*a* of a connection part 3 through the concave groove part.

The fuel which has reached the spray holes 3*a* of the connection part 3 is sprayed toward the hollow part 2*b* of the second case 2 through the spray holes 3*a* and collide in all directions with the disperse protrusions of the rotation atomizing tubes 7 disposed at the hollow part 2*b*.

The fuel passes through the rotation atomizing tubes 7, 8, 9 and no-rotation atomizing tubes 7', 8', 9' which are stacked in layers, respectively. Here, the fuel flows along the spiral rotation protrusions 7*a*, 8*a*, 9*a* of the rotation atomizing tubes 7, 8, 9, thus axially rotating the rotation atomizing tubes 7, 8, 9, and the fuel passes through the straight rotation protrusion 7'*a*, 8'*a*, 9' a of the no-rotation atomizing tubes 7', 8' 9' as it pushes the same upwards. The fuel is atomized again with the aid of the collisions between the axial rotation of the rotation atomizing tubes 7, 8, 9 and the straight rotation protrusions 7'*a*, 8'*a*, 9' a of the no-rotation atomizing tubes 7', 8', 9', and then is exhausted through the fuel outlet 2*a* of the second case 2 through the fuel through holes, so the fuel atomized into atomized particles is supplied to the engine.

A change occurs in the pressure depending on the consumption of the fuel exhausted through the fuel outlet 2*a*. The change in pressure, for example, results in a reduction in the consumption of fuel. As the pressure at the side of the fuel outlet 2*a* increases, the layer-upon-layer stacked rotation atomizing tubes 7, 8, 9 and no-rotation atomizing tubes 7', 8', 9' are pushed toward the connection part 3, thus blocking the spray holes 3*a* and consequently interrupting the introductions of fuel. As the pressure at the side of the fuel outlet 2*a* decreases, they are pushed back by means of the spray pressure of the fuel, so the spray holes 3*a* of the connection part 3 are opened, thus supplying the fuel again.

The fuel is atomized into particles and is fully mixed with oxygen, so the perfect combustion of fuel can be obtained, which results in improving consumption efficiency.

The conventional fuel saving device has disadvantages in that when the fuel inlet of the first case and the fuel outlet of the second case are connected to the fuel supply hose connected to the side of the fuel tank and the fuel exhaust hose connected to the side of the engine, respectively, it is needed to insert the fuel inlet and the fuel outlet into the interiors of the fuel supply and exhaust hoses, respectively, and then they are tightened and secured by a clamp, the procedures of which seem to be very complicated.

In the conventional fuel saving apparatus, the inner spaces of the first case and the second case are arranged in perpendicular directions, so when the fuel flows at a high speed, the fuel collides a lot with the right angle portions, thus causing a lot of turbulences, which retards the flow speed of fluid. The continuous collisions might result in a lot of abrasions or damages.

In the conventional fuel saving apparatus, the first and second rotation atomizing parts rotate at high speeds by means of the flowing fuel in the interior of the first case. The continuous rotations consequently lead to abrasions at the inner side wall surface of the first case, and the first and second rotation atomizing parts cause a space between the inner side wall surfaces of the first case due to the abrasions, so the amount of the fuel straightly flowing without allowing the first and second atomizing parts to rotate, increases for thereby deteriorating the efficiency of atomizing.

In the conventional fuel saving device, fuel cohesive force is a key factor in terms of the fuel which is supplied from the fuel supply device(fuel tank) to the first case. The atomization efficiency of the fuel might decrease when trying to atomize the fuel following the attenuation of the cohesive force by the first and second rotation atomizing parts.

The conventional fuel saving device has disadvantages in that since liquid fuel gathers at the front side of the acceleration part (the direction that the fuel is introduced) in an upward direction, and the gaseous fuel gathers in a downward direction, and the condensed, deposited or floating substances contained in the fuel gather at in a downward direction, a differential pressure decreases, so the flowing performance of the fuel significantly decreases.

So, it is urgently needed to develop a new environmentally friendly fuel activation device which has a simple and reliable connection with the fuel supply and exhaust hoses, and the atomization force is enhanced with the aid of attenuation of cohesive force of the fuel, and the fuel does not freeze when the temperature is below zero, and collision or turbulence is suppressed when the fuel flows at a high speed, thus preventing the flowing rate of the fuel from lowering. The over consumption of the fuel is prevented, and the fuel can be saved a lot, and the exhaust of the air pollutant is minimized.

As the volume of the fuel particles supplied(sprayed) through the fuel saving apparatus decreases, the area contacting with the is increases, and the combustion time advantageously decreases; however 100% complete combustion is not performed by means of the amount of air additionally supplied.

Alternatively, there is provided an emulsified fuel which is combusted along with a fuel and a small amount of water. The emulsified fuel combustion system might be implemented in various forms; however the emulsified fuel combustion system generally is composed of a liquid fuel tank, a water tank, a combustion assistant device receiving a liquid fuel and water, thus manufacturing emulsified fuel, a storing tank storing an emulsified fuel, and a boiler receiving and combusting the emulsified fuel.

The combustion assistant device is generally formed of a case with an emulsifying chamber, and an impeller which emulsifies the fuel in such a way to stir liquid fuel and water in the emulsifying chamber.

As the impeller is operated, and the liquid fuel of the liquid fuel tank and the water of the water tank are transferred to the case, the liquid fuel and the water are emulsified during the operations of the impeller as the liquid fuel and the water pass through the emulsifying chamber, thus preparing emulsified fuel which is to be stored in the storing tank and is supplied to the combustion chamber for combustion.

As mentioned above, the conventional art has the following disadvantages.

The emulsified fuel has different emulsified states such as an addition ratio of water for the liquid fuel depending on the condition of a manufacture condition, due to which combustion states appear different in the boiler. As a measure to optimize the combustion states when combustion states are bad, there is a way increasing the supply amount of air so that emulsified fuel can have more chances of contacting with air.

The above described methods seem to improve a little combustion performances in effective ways; however the effects as obtained are not practical, and such methods do not seem to be necessary measures.

In the emulsifying methods, liquid fuels and water are emulsified by easily stirring them with impellers, which takes a lot of time to manufacture emulsified fuel. So, it is impossible to continue the manufacture of emulsified fuel, which means that the emulsified fuel cannot be instantly supplied to the boiler.

The emulsified fuel finished stands very unstable in its emulsified state, so emulsifying agents (such as surfactant or the like) is necessarily needed for stabilizing the emulsified state.

DISCLOSURE OF INVENTION

Accordingly, it is an object of the present invention to provide an environmentally friendly fuel activation device which makes it possible to enhance an atomization efficiency with the aid of attenuation of cohesive force of fuels, while overcoming the problems encountered in the conventional art.

It is another object of the present invention to implement an easier installation in such a way to use a simple one touch method or an union engagement method in terms of the engagement with fuel tubes.

It is further another object of the present invention to prevent the flowing performance from worsening in such a way to make the portions contacting with flowing fuels, smoothly curved, thus substantially preventing turbulences.

It is further another object of the present invention to prevent the loss of differential pressures depending on the fuel conditions of liquid fuels and gaseous fuels.

It is further another object of the present invention to maximize the energy efficiency in such a way to add a small amount of atomized fuel moistures to the atomized fuels for thereby increasing the combustion rate of the fuels.

To achieve the above objects, there is provided an environmentally friendly fuel activation device which is basically directed to supplying emulsified fuel mixed, at a certain ratio, with water and fuel with the aid of a first valve coupled to a water supply tube and a second valve coupled to a fuel supply tube and comprises:

a first case which has a fuel inlet part coupled to the supply tube, a hollow part and fuel cohesive force attenuation means;

a second case which has a fuel exhaust part coupled to the exhaust fuel tube and a hollow part;

a connector which connects the first case and the second case and has a spray hole at its central portion;

a first rotation atomization part which is arranged close to the fuel inlet part of the first case and has a spiral groove at its own outer circumferential is surface in a longitudinal direction;

acceleration parts which are arranged close to the first rotation atomization part and has a spray hole at its own central portion;

a second rotation atomization part which is arranged close to the acceleration part and has a spiral groove at its own outer circumferential surface in a longitudinal direction in the direction opposite to the spiral groove;

a first rotation atomization tube which serves to open and close the spray hole of the connector and has a spiral rotation protrusion at its own outer circumferential surface in a rotation direction;

a first no-rotation atomization tube which is arranged at a hollow part of the second case and surrounds the first rotation atomization tube and has a straight rotation protrusion at its own outer circumferential surface in a rotation direction;

a second rotation atomization tube which is arranged surrounding the first no-rotation atomization tube and has a spiral rotation protrusion at its own outer circumferential surface in a rotation direction;

a second no-rotation atomization tube which is arranged surrounding the second rotation atomization tube and has a straight rotation protrusion at its own outer circumferential surface in a rotation direction;

a third rotation atomization tube which is arranged surrounding the second no-rotation atomization tube and has a spiral rotation protrusion at its own outer circumferential surface in a rotation direction; and a third no-rotation atomization tube which is arranged surrounding the third rotation atomization tube and has a straight rotation protrusion at its own outer circumferential surface in a rotation direction.

According to a preferred embodiment of the present invention, the connection method of the fuel inlet part and the supply fuel tube of the first case and the fuel inlet part and the exhaust fuel tube of the second case is performed by selecting one between the one-touch method and the union method.

According to a preferred embodiment of the present invention, the fuel cohesive force attenuation means of the first case is characterized in that the fuel supplied from the supply fuel tube I lose its own cohesive force with the aid of magnetic forces while the fuel passes through a plurality of serially arranged magnets, a plurality of spiral nozzles or porous balls.

According to a preferred embodiment of the present invention, the hollow parts of the first and second cases are characterized in that the right angle portions directly contacting with fuel are made sloped, thus preventing turbulences of the fuel, which leads to preventing the decrease of fluidity of the fuel and damages of the right angle portion.

According to a preferred embodiment of the present invention, the acceleration part is detachably engaged to the first case, with the first and second rotation atomization parts being inserted into the opposite side about the acceleration part where the spray holes are formed at the central portion.

According to another embodiment of the present invention, there is further provided an atomized foam generator which is engaged at the spray hole I' of the supply fuel tube I and supplies atomized moistures.

According to another embodiment of the present invention, The atomized foam generator comprises a water tank which supplies water; a body which receives and stores water and has spray holes so foams atomized by ultrasonic waves can be inputted into the spray holes of the connector; an ultrasonic wave generator which radiates ultrasonic waves to water supplied from the lower side of the body; and a float switch which is installed at one side of the body and controls the ultrasonic wave generator.

ADVANTAGEOUS EFFECTS

The present invention has the following advantageous effects.

The present invention provides an environmentally friendly fuel activation apparatus which makes it possible to enhance combustion efficiency with the aid of the mixture of emulsified fuel and oxygen while improving the atomization force by attenuating the cohesive force between water and fuels.

It is appreciated that the installation becomes easier by using a simple one touch method or an union engagement method in terms of the engagement with fuel tubes.

The present invention can prevent the flowing performance of the fuel from worsening in such a way to prevent turbulence by making the portions contacting with flowing fuels, smoothly curved.

It is appreciated that the decrease of the differential pressure can be prevented depending on the fuel conditions of liquid fuels and gaseous fuels.

The parts which used to easily wear out due to rotation frictions can be replaced, thus reducing part exchange and repair costs.

The combustion efficiency of fuel can be improved by adding a small amount of atomized fuel moisture to the atomized fuel, which leads to maximizing energy efficiency.

BRIEF DESCRIPTION OF THE DRAWINGS

The present invention will become better understood with reference to the accompanying drawings which are given only by way of illustration and thus are not limitative of the present invention, wherein.

BEST MODES FOR CARRYING OUT THE INVENTION

The preferred embodiments of the present invention will be described with reference to the accompanying drawings.

Figure 1:
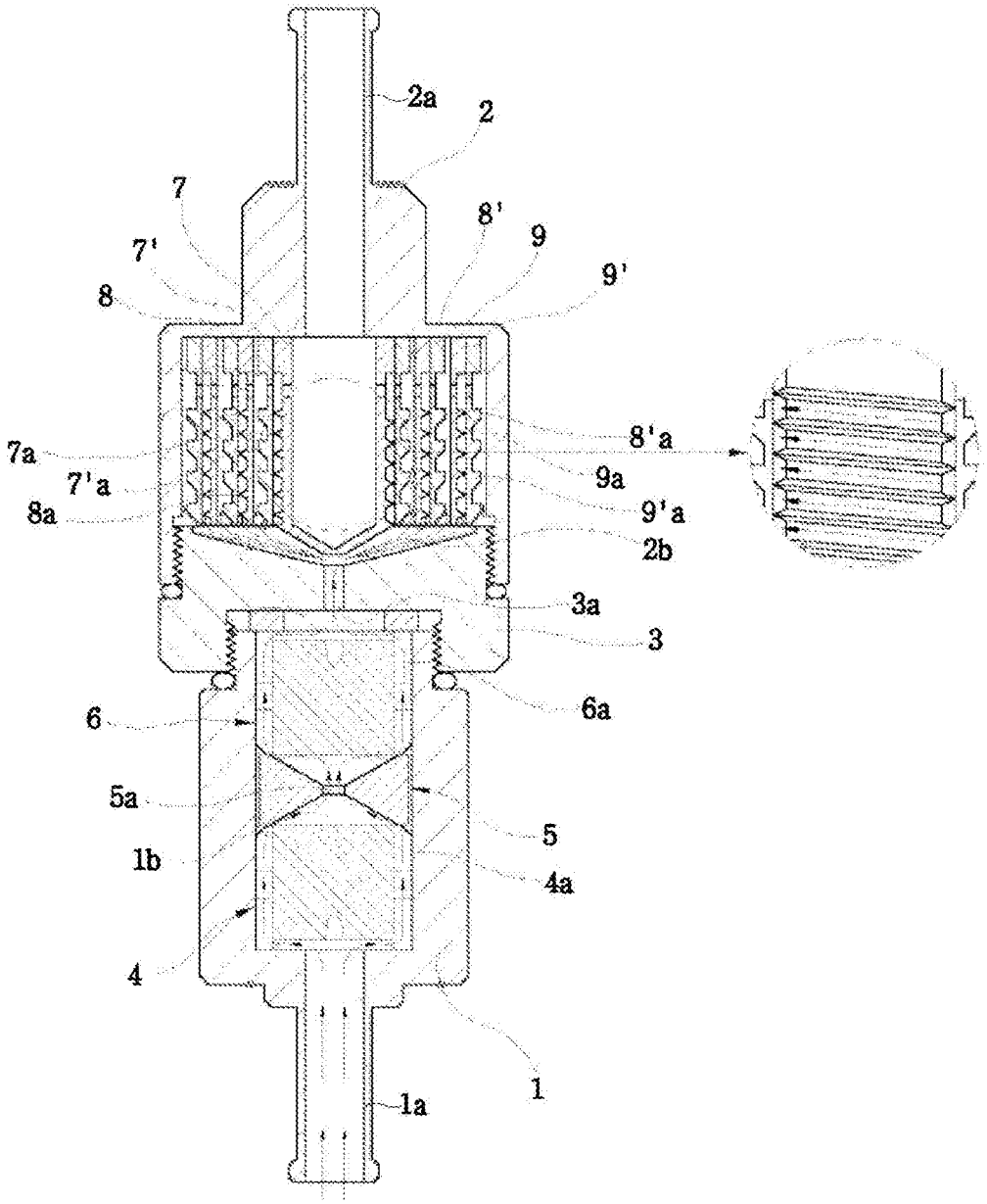
FIG. 1 is a cross sectional view illustrating a conventional fuel saving device.
Figure 2:
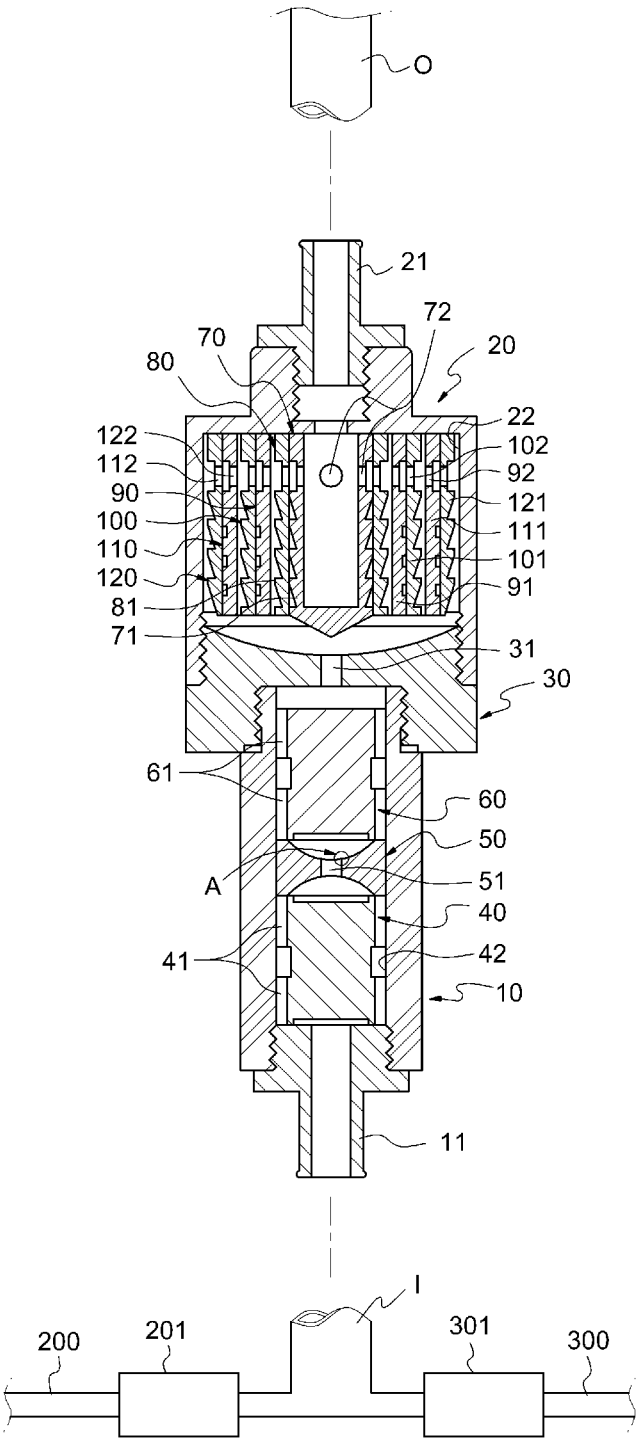
FIG. 2 is a cross sectional view illustrating an environmentally friendly fuel activation device according to the present invention.
Figure 10:
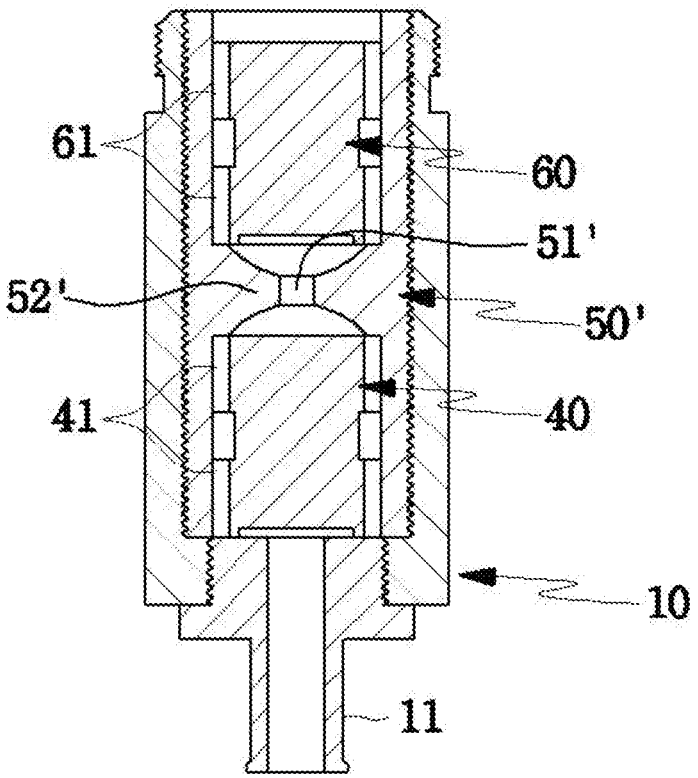
FIG. 10 is a cross sectional view illustrating a state that an acceleration part is applied to a first case according to another embodiment of the present invention.

As shown in FIGS. 2 and 10, the environmentally friendly fuel activation device comprises a first case 10, a second case 20, a connector 30 connecting both the first and second cases 10 and 20, a first rotation atomization part 40, an accelerator part 50, 50', and a second rotation atomization part 60 installed in the interior of the first case 10 whereas a first rotation atomization tube 70, a first no-rotation atomization tube 80, a second rotation atomization tube 90, a second no-ration atomization tube 100, a third rotation atomization tube 110, and a third no-rotation atomization tube 120 are installed in the interior of the second case 20, respectively.

The first case 10 has a fuel inlet 11 connected to the supply fuel tube I, a hollow part 12, and fuel cohesive force attenuation means 13, 14, 15, and 16.

The emulsified fuel made by mixing water and fuel at a ratio of 20~30 weight % and 70~80 weight % with the first valve 201 connected to the water supply tube 200 and the second valve 301 connected to the fuel supply tube 300 is supplied to the supply tube 1.

Figure 3:
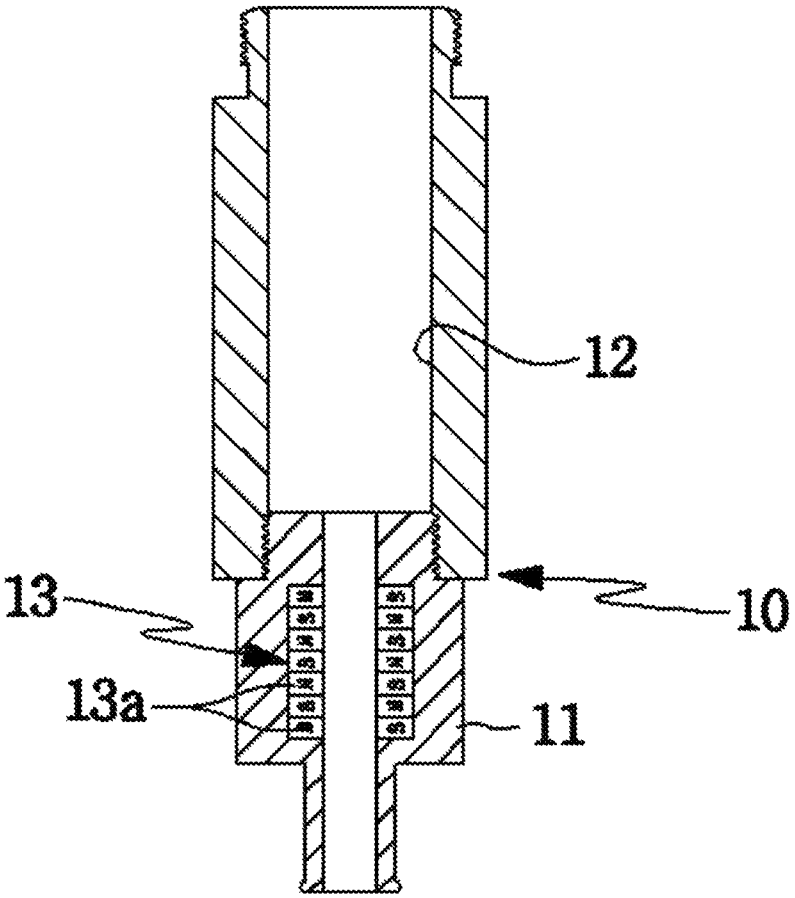
FIGS. 3 to 6 are cross sectional views illustrating a fuel cohesive force attenuation means applied to a first case.

As shown in FIG. 3, the cohesive force attenuation mean 13 is constituted so the fuel supplied from the supply fuel tube I is forced to flow through the center of the magnets 13*a* arranged in series, thus attenuating the cohesive force of the fuel with the aid of magnetic force.

Figure 4:
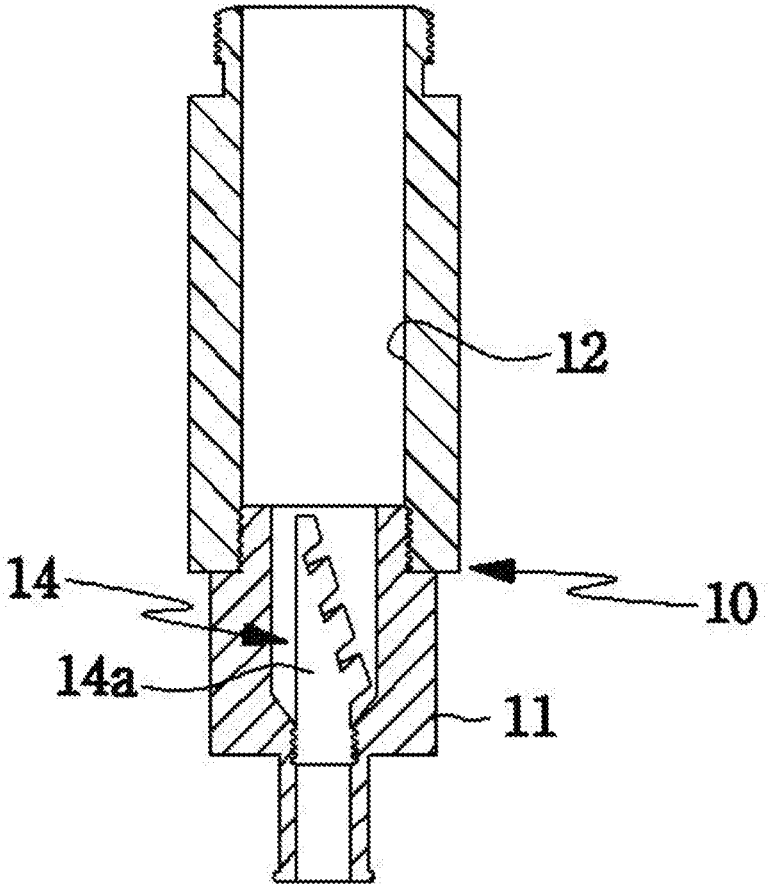

As shown in FIG. 4, the cohesive force attenuation means 14 is so configured that the cohesive force is attenuated by spraying at a high speed the fuel supplied from the supply fuel tube I through a spiral nozzle 14*a*.

Figure 5:
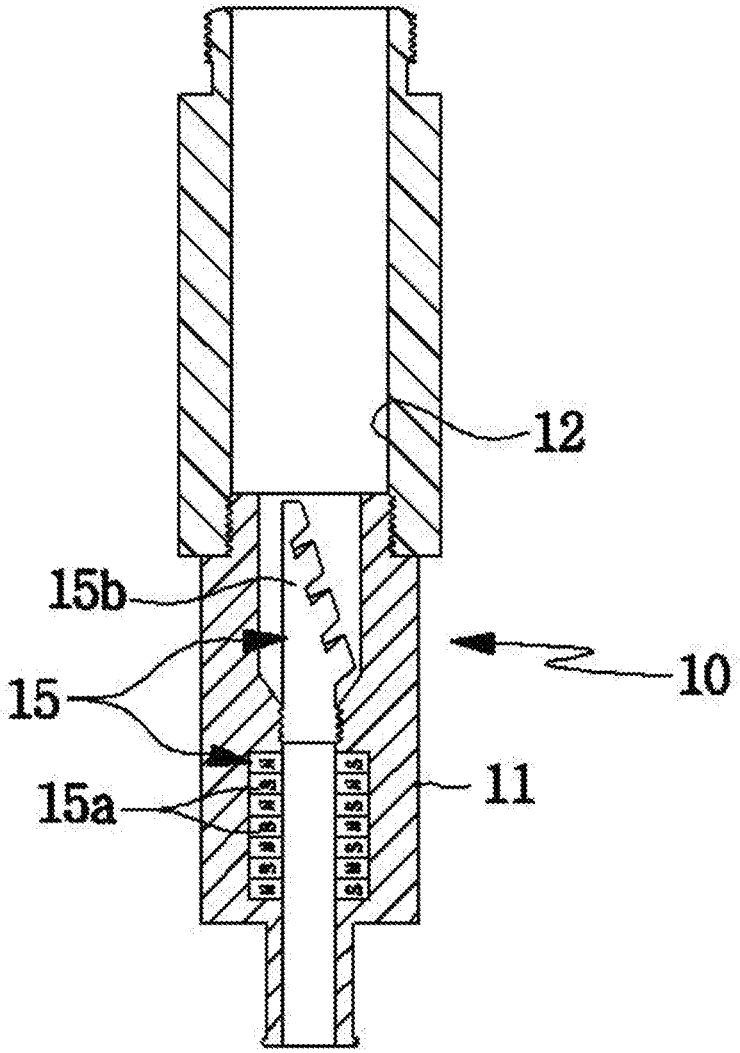

As shown in FIG. 5, the cohesive force attenuation means 15 serves to re-spray the fuel, which has passed through the center of the magnets 15*a*, which are serially arranged, through the spiral nozzle 15*b*, so the cohesive force of the fuel is attenuated by means of the magnetic force of the magnets 15*a* and the rotational spraying force of the spiral nozzle 15*b*.

Here, the spiral nozzle 15*b* serves to make the fuel flow in a cochlear duct shape and sprays the fuel at a high speed, thus accelerating the flow of fuel and attenuating the cohesive force.

Figure 6:
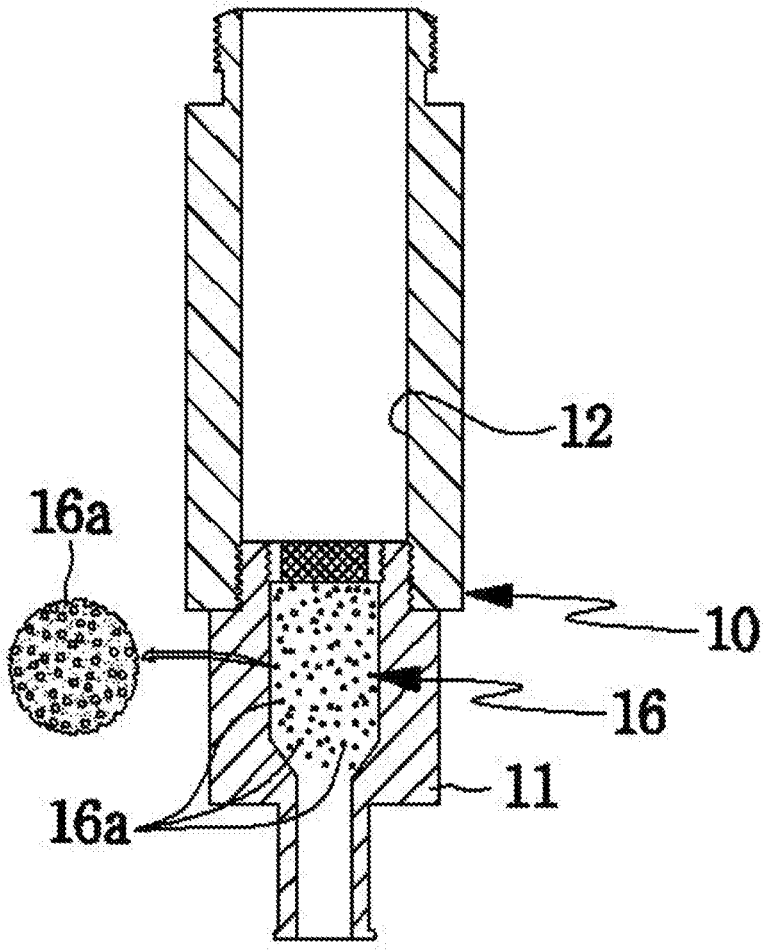

As shown in FIG. 6, the cohesive force attenuation means 16 is designed to attenuate the cohesive force of fuel with the aid of collision force as the fuel from the supply fuel tube I passes through the porous balls 16*a*.

Each porous ball 16*a* is formed of numerous pores. As the fuel is inputted into each pore, so the porous balls 16*a* serve to move actively colliding with the fuel.

The second case 20 is formed of a fuel exhaust port 21 connected with an exhaust fuel tube O, and a hollow part 22.

The connection method of the fuel inlet 11 and the supply fuel tube I of the first case 10 and the fuel inlet 21 and the exhaust fuel tube O of the second case is selected from the group consisting of the one touch method and the union method.

Figure 7:
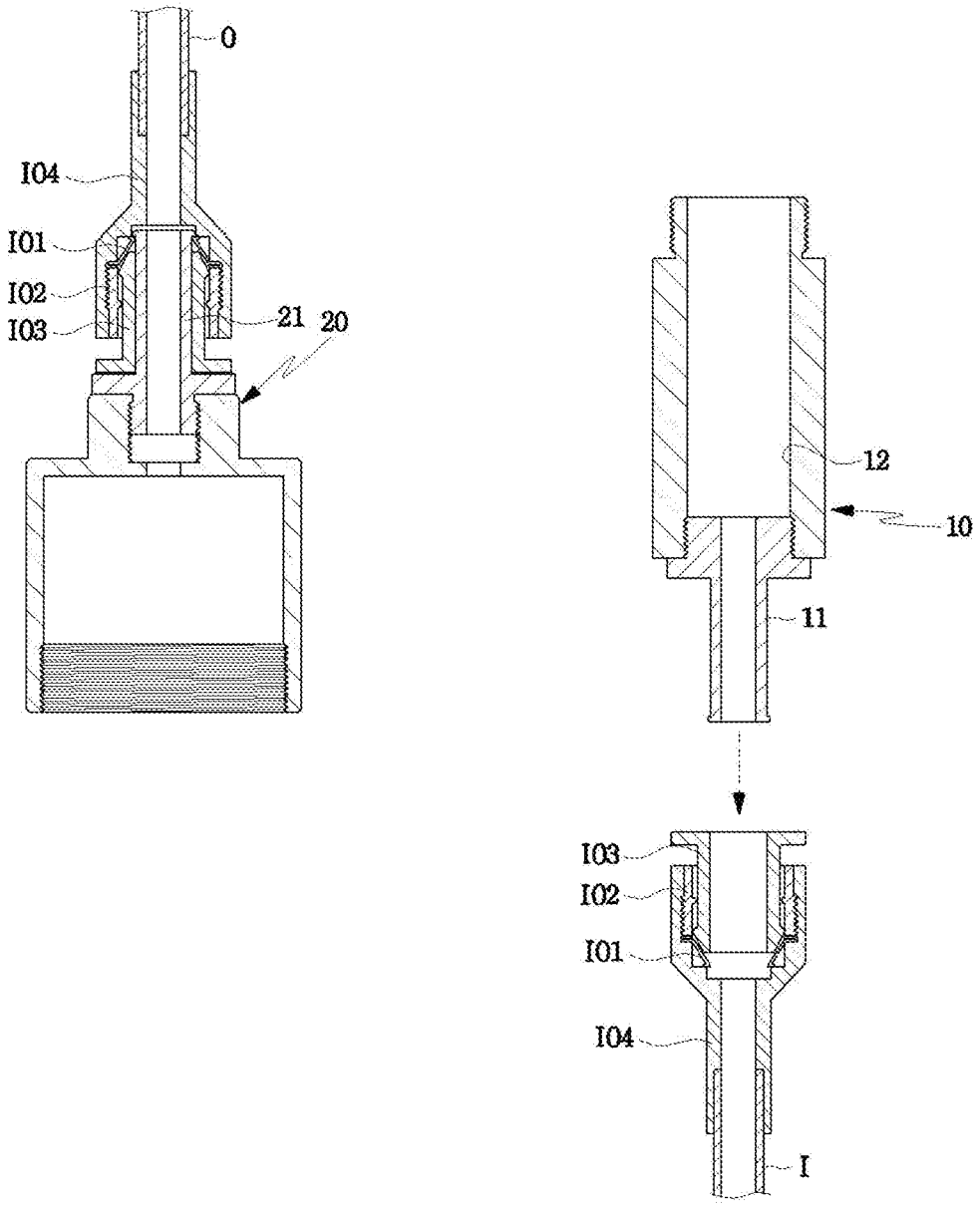
FIG. 7 is a cross sectional view illustrating a one-touch connection method of first and second cases, supply fuel tube, and an exhaust duel tube.

As shown in FIG. 7, the one touch method is characterized in that a coupling IO4 with a driving part IO3 engaging and disengaging a stopper IO1 is secured along a fixing unit IO2 supporting a stopper IO1 in which the fuel inlet 11 or the fuel exhaust port 21 of the first and second cases 10 and 20 are inserted into and caught by the supply fuel tube 1 and the exhaust fuel tube O.

When the fuel inlet 11 or the fuel exhaust port 21 is inserted into the interior of the driving part IO3 of the coupling IO4, the end portion of the fuel inlet 11 or the fuel exhaust port 21 causes the stopper IO1 to expand in all directions and proceeds, so the stopper IO1 supports the protruded end portion of the fuel inlet 11 or the duel exhaust port 21 for thereby preventing disengagements.

In addition, when it is needed to disconnect, the stopper IO1 expands in all directions when the driving part IO3 is pressed, and goes away from a protruded end portion of the fuel exhaust port 21 or the fuel inlet 11, thus escaping from the same.

Figure 8:
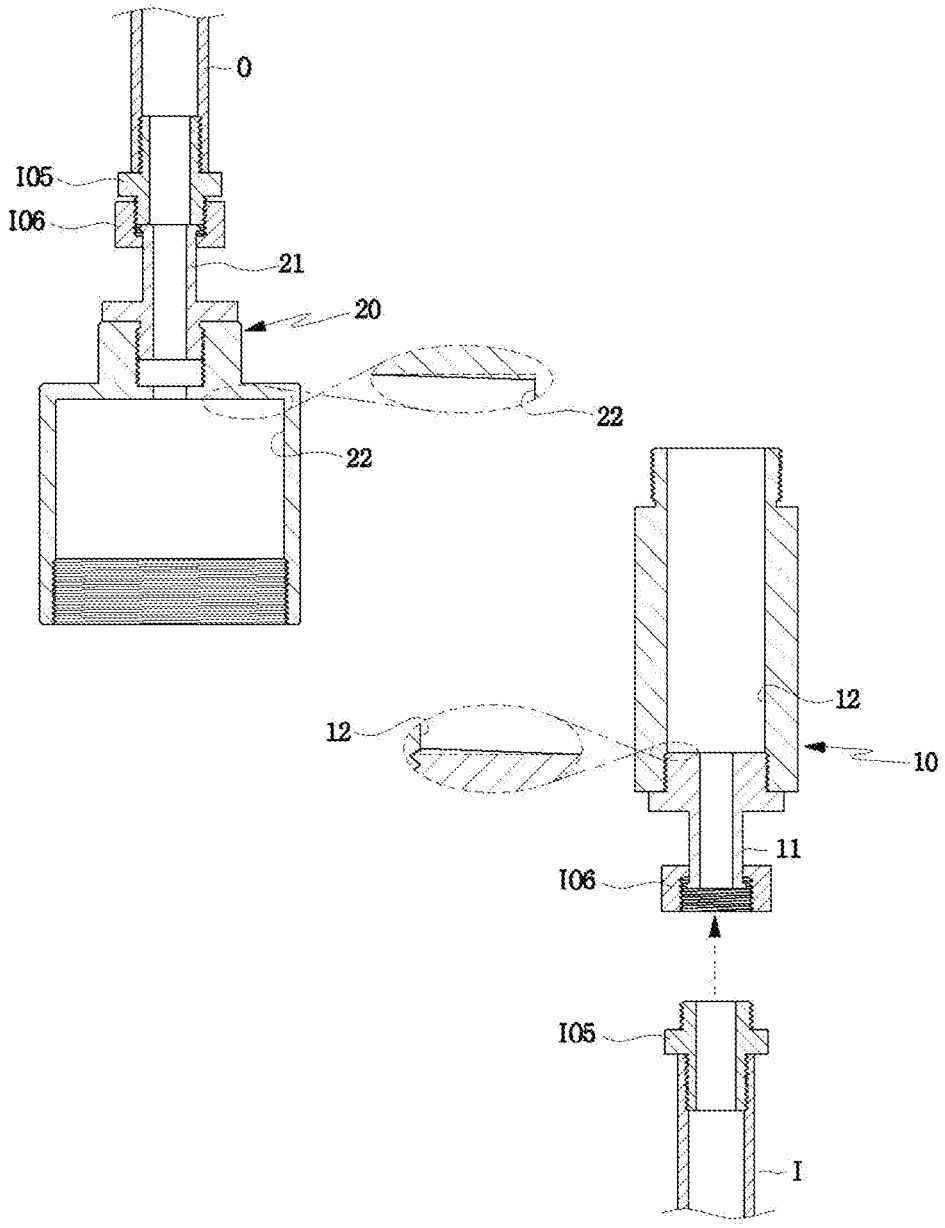
FIG. 8 is a cross sectional view illustrating an union connection method of first and second cases, a supply fuel tube and an exhaust fuel tube.

As shown in FIG. 8, the union engaging method is characterized in that an adaptor IO5 is connected to the supply fuel tube I and the exhaust fuel tube O, respectively, and a nut IO6 secured to the adaptor IO5 is freely movably coupled to the fuel inlet 11 and the fuel exhaust port 21, and the end portions of the supply fuel tube 1, the exhaust fuel tube O, the fuel inlet 11 and the fuel exhaust port 21 are linked to communicate with each other, and the nut IO6 is secured to the adaptor IO5.

On the contrary, when it is needed to disassemble, the nut IO6 is loosened from the adaptor IO5, this disassembling the same.

The hollow parts 12 and 22 of the first and second cases 10 and 20 are formed in such a way that the right angle portions directly contacting with fuel are formed with a slope, thus preventing turbulence of fuel, whereby to prevent the decrease of flow performance and damages.

When fuel flows, since the right angle portions of the first and second cases 10 and 20 are made to have a slope, by which it is possible to decrease flow resistances of the fuel and prevent turbulence which used to occur at the right angle portions. The damages of the first and second cases 10 and 20 can be consequently prevented, which damages used to occur due to continuous turbulences and continuous collisions at the right angle portions.

There are further provided freezing prevention means 140 and 150 at the first and second cases 10 and 20 in order to prevent the fuel from freezing.

Figure 9:
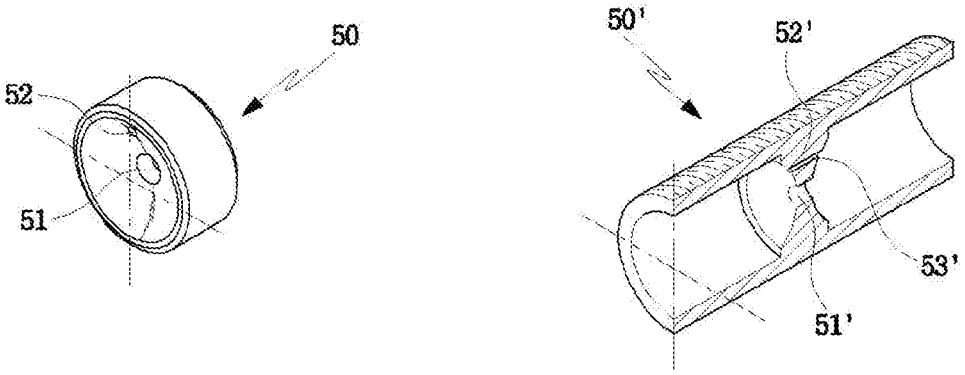
FIG. 9 is a cut-away perspective view illustrating a construction that a ventilation hole is formed at an acceleration part according to another embodiment of the present invention.

As shown in FIG. 9, the accelerator part 50 is cylindrical with its height getting higher in its edge direction about the spray holes 51.

The accelerator part 50' is engaged to or disengaged from the first case 10, and the first rotation atomization part 40 and the second rotation atomization part 60 are inserted into opposite portions about the accelerator part 52' with the spray holes 51' being formed at its central portion.

As shown in FIG. 10, the accelerator part 50' is disengaged from or engaged to the first case 10. In the present invention, the engagement or disengagement is performed with the aid of the thread engagement method. For the accelerator part 50' from being engaged or disengaged, a female thread is formed at an inner surface of the hollow part 12 of the first case 10.

The accelerator 50' can be easily exchanged when it is worn out by means of the strong rotational forces of the first rotation atomization part 40 and the second rotation atomization part 60 which rotate at high speeds by means of the spray of the fuel since the first and second rotation atomization tubes 40 and 60 are made of materials having weak mechanical strengths.

As shown in FIG. 9, the accelerators 50 and 50' have ventilation holes 52 and 53' at their upper sides for preventing differential pressures as condensation, deposit substances, floating substances or the like gather at the front side of the same.

The diameter of the ventilation hole 52 is in a range of 0.5~1% of the surface area of the accelerator 50, and the diameter of the ventilation hole 53' is in a range of 0.5~1% of the surface area of the accelerator part 52'.

Figure 11:
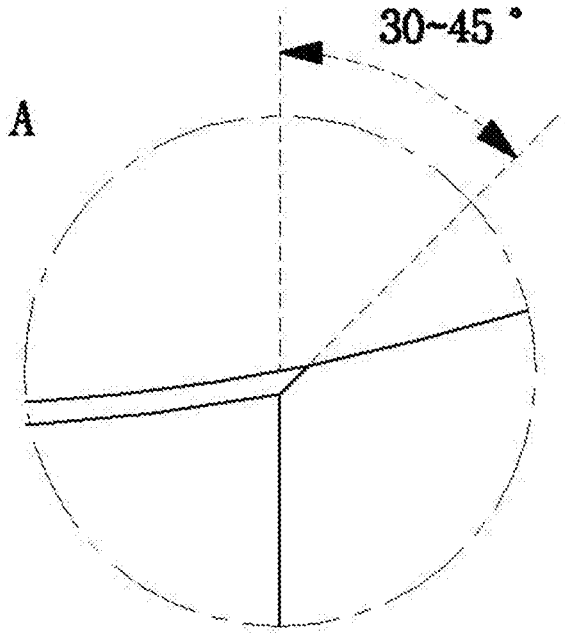
FIG. 11 is a schematic view illustrating an edge angle of an acceleration part as an enlarged view of the portion A of FIG. 2.

A shown in FIG. 11, the edge angles of the spray holes 51 and 51' of the accelerators 50 and 50' are in a range of 34~45°, thus substantially preventing the occurrence of turbulences.

As shown in FIG. 2, the second rotation atomization part 60 is to arranged close to the accelerator part 50, and a spiral groove 61 is formed on a circumferential surface in the opposite direction of the spiral groove 41 in a longitudinal direction.

Namely, the second rotation atomization part 60 and the first rotation atomization part 40 rotate in opposite directions by means of a flowing force of the fuel, thus rotating, atomizing and spraying the fuel with the formation directions of the spiral grooves 61 and 41 being opposite.

The first rotation atomization tube 70 opens and closes the spray holes 31 of the connection part 30, with a spiral rotation protrusion 71 being formed on an outer circumferential surface in a rotation direction. A fuel inlet hole 72 is formed at its own upper side for injecting fuel.

At this time, the first rotation atomization tube 70 is characterized in that the spray holes are opened by means of a spray force generated as the fuel atomized by means of the rotation of the first and second rotation atomization tubes 40 and 60 installed in the interior of the first case 10 is sprayed through the spray holes 31 of the connection part 30. When the spray force of the fuel is removed, it is closed.

The first no-rotation atomization tube 80 is arranged at the hollow part 22 of the second case 20, surrounding the first rotation atomization tube 70, and a straight rotation protrusion 81 is formed at an outer circumferential surface in a rotation direction, and a fuel inlet hole 82 is formed at an upper side for receiving fuel, while communicating with the fuel inlet hole 72 of the first rotation atomization tube 70.

The second rotation atomization tube 90 is arranged surrounding the first no-rotation atomization tube 80 and a spiral rotation protrusion 91 on its own outer circumferential surface in a rotation direction, and has a fuel inlet hole 92 at its own upper side for receiving fuel in such a way to communicate with the fuel inlet hole 72 of the first rotation atomization tube 70 and the fuel inlet hole 82 of the first no-rotation atomization tube 80.

Here, the second rotation atomization tube 100 is arranged surrounding the second rotation atomization tube 90 and has a straight rotation protrusion 101 at its own outer circumferential surface in a rotation direction, and has a fuel inlet hole 102 at its own upper side for receiving fuel in such a way to communicate with the fuel inlet hole 72 of the first rotation atomization tube 70 and the fuel inlet hole 82 of the first no-rotation atomization tube 80, and the fuel inlet hole 92 of the second rotation atomization tube 80, respectively.

The third rotation atomization tube 110 is arranged surrounding the second no-rotation atomization tube 100 and has a spiral rotation protrusion at its own circumferential surface, and has a fuel inlet hole 112 at its own upper side for receiving fuel in such a way to communicate with the fuel inlet hole 72 of the first rotation atomization tube 70, the fuel inlet hole 82 of the first no-rotation atomization tube 80, the fuel inlet hole 92 of the second rotation atomization tube 90, and the fuel inlet hole 102 of the second no-rotation atomization tube 100, respectively.

The third no-rotation atomization tube 120 is arranged surrounding the third atomization tube 110 and has a straight rotation protrusion 121 at its own outer circumferential surface in a rotation direction, and has a fuel inlet hole 122 at its own upper side for receiving fuel in such a way to communicate with the fuel inlet hole 72 of the first rotation atomization tube 70, the fuel inlet hole 82 of the first no-rotation atomization tube 80, the fuel inlet hole 92 of the second rotation atomization tube 90, the fuel inlet hole 102 of the second no-rotation atomization tube 100, and the fuel inlet hole 112 of the third rotation atomization tube 110, respectively.

The operation of the present invention with the above construction will be described as follows.

As shown in FIGS. 2 to 11, the fuel activation device can be well applied to a boiler which uses a combustion device such as a burner or the like and can be generally installed between various combustion devices and a fuel supply device The emulsified fuel made by mixing water and fuel at ratios of 20~30 weight % and 70~80 weight % with the aid of the first valve 201 coupled to the water supply tube 200 and the second valve 301 coupled o the fuel supply tube 300 is supplied to the supply tube I, thus consequently supplying to the fuel inlet pot 11 of the first case 10.

In the interior of the first case 10 are sequentially installed a first rotation atomization part 40, an acceleration part 50, and a second rotation atomization part 60, with the directions of the spiral grooves 41 and 61 of the first and second rotation atomization tubes 40 and 60 being opposite.

When the acceleration part 50' is installed, the first rotation atomization part 40 is inserted at the side of the fuel inlet part 11 about the acceleration part 52' and the second rotation atomization part 60 is installed at the opposite side, with the directions of the spiral grooves 41 and 61 of the first and second rotation atomization tubes 40 and 60 being opposite.

Next, the connector 30 is coupled to the first case 10, and the first no-rotation atomization tube 80, the second rotation atomization tube 90, the second no-rotation atomization tube 100, the third rotation atomization tube 110, and the third no-rotation atomization tube 120 are sequentially surrounded with the first rotation atomization tube 70 being disposed at the central portion, and then are installed in the interior of the second case 20. Here, the device of the present invention is installed so that the first rotation atomization tube 70 can open and close the spray holes 31 of the connector 30, thus coupling the connector 30 and the second case 20, whereby to finish the assembly of the fuel activation device.

The fuel activation device of the present invention is characterized in that the fuel inlet part 11 of the first case 10 is connected to the supply tube I connected to the side of the fuel tank and fuel supply device, and the second case 20 is connected to the exhaust tube O connected to the side of the engine.

Here, the present invention is advantageous in that the fuel activation device can be easily, fast installed based on the union method.

In the installation finished fuel activation device, when emulsified fuel is supplied from the fuel supply device, cohesive force of fuel is attenuated by means of the cohesive force attenuation means 13, 14, 15 and 16 of the emulsified fuel of the first case 10 and is supplied with the fuel atomized.

Here, the cohesive force attenuation means 13, 14, 15 and 16 might be implemented in various forms the application of which can be selectively applied depending on the states of the emulsified fuel, thus enhancing the universal application.

When the emulsified fuel the cohesive force of which is attenuated is inputted into the interior of the first cast 10, the first rotation atomization part 40 rotates at a high speed, thus atomizing the emulsified fuel, and the atomized, emulsified fuel moves through the spray holes 51 an 51' of the acceleration parts 50 and 50', thus rotating in reverse direction the second rotation atomization part 60, which leads to a higher atomization powder.

At this time, since the emulsified fuel is a mixture of water and liquid fuel such as gasoline, light oil, kerosene, bunker-c oil, etc., differential pressure occurs owing to the ventilation holes 52 and 53', so condensation phenomenon generally occurring at the front side surface where the fuel of the acceleration part 50 flows in and the front side surface where the emulsified fuel of the acceleration part end 52' of the acceleration part 50' are prevented, thus guarantying the smooth flow of the emulsified fuel.

The emulsified fuel atomized based on a high speed rotation while passing through the second rotation atomization part 60 flows fast into the interior of the second case 20 through the spray holes 31 of the connector 30.

The atomized, emulsified fuel is inputted into the interior of the second case 20 through the spray holes 31. Here, the first rotation atomization tube 70 opens the spray holes 31 with the aid of the spray force of the emulsified fuel, and the emulsified fuel flows along the spiral rotation protrusion 71 of the first rotation atomization tube 70, and the first rotation atomization tube 70 rotates, and the first no-rotation atomization tube 80 moves along the straight rotation protrusion 81, and the first no-rotation atomization tube 80 does not rotate, and the second rotation atomization tube 90 moves along the spiral rotation protrusion 91, and the second rotation atomization tube 90 rotates, and the second no-rotation atomization tube 100 moves along the straight rotation protrusion 101, and the second no-rotation atomization tube 100 does not rotate, and the third rotation atomization tube 110 moves along the spiral rotation protrusion 111, and the third rotation atomization tube 110 rotates, and the third no-rotation atomization tube 120 moves along the straight rotation protrusion 121, and the third no-rotation atomization tube 120 does not rotate. The emulsified fuel sequentially passes through each of the above processes, namely, the rotation operations and the atomization operations are alternately performed with respect to the emulsified fuel, which results in more atomization processes, thus increasing the contents of oxygen in the emulsified fuel.

While the atomized, emulsified fuel randomly passes through the fuel inlet holes 72, 82, 92, 102, 112, and 122 of the first rotation atomization tube 100, the first no-rotation atomization tube 80, the second rotation atomization tube 90, the second no-rotation atomization tube 100, the third rotation atomization tube 110, and the third no-rotation atomization tube 120, and while the atomized, emulsified fuel is supplied to the combustion device of the boiler through the exhaust tube O through the fuel exhaust part 21 of the second case 20; therefore the atomized, emulsified fuel is processed by the dispersion and filtering of the emulsified fuel, the collision and turbulence, the first turbulence, the collision and reverse turbulence, the second turbulence, the collision, the third turbulence, and the dispersions. The kinetic energy of the fuel is maximized, so an enough mixture with oxygen is obtained, and perfect combustion is obtained in the course of the combustion.

The right angles of the first and second cases 10 and 20 are made sloped, so the decrease of the fluidity of the emulsified fuel flowing at a high speed is minimized, and it is possible to prevent the damages by means of the emulsified fuel having a high speed fluidity.

MODES FOR CARRYING OUT THE INVENTION

Another embodiment of the present invention will be described with reference to the accompanying drawings.

Figure 12:
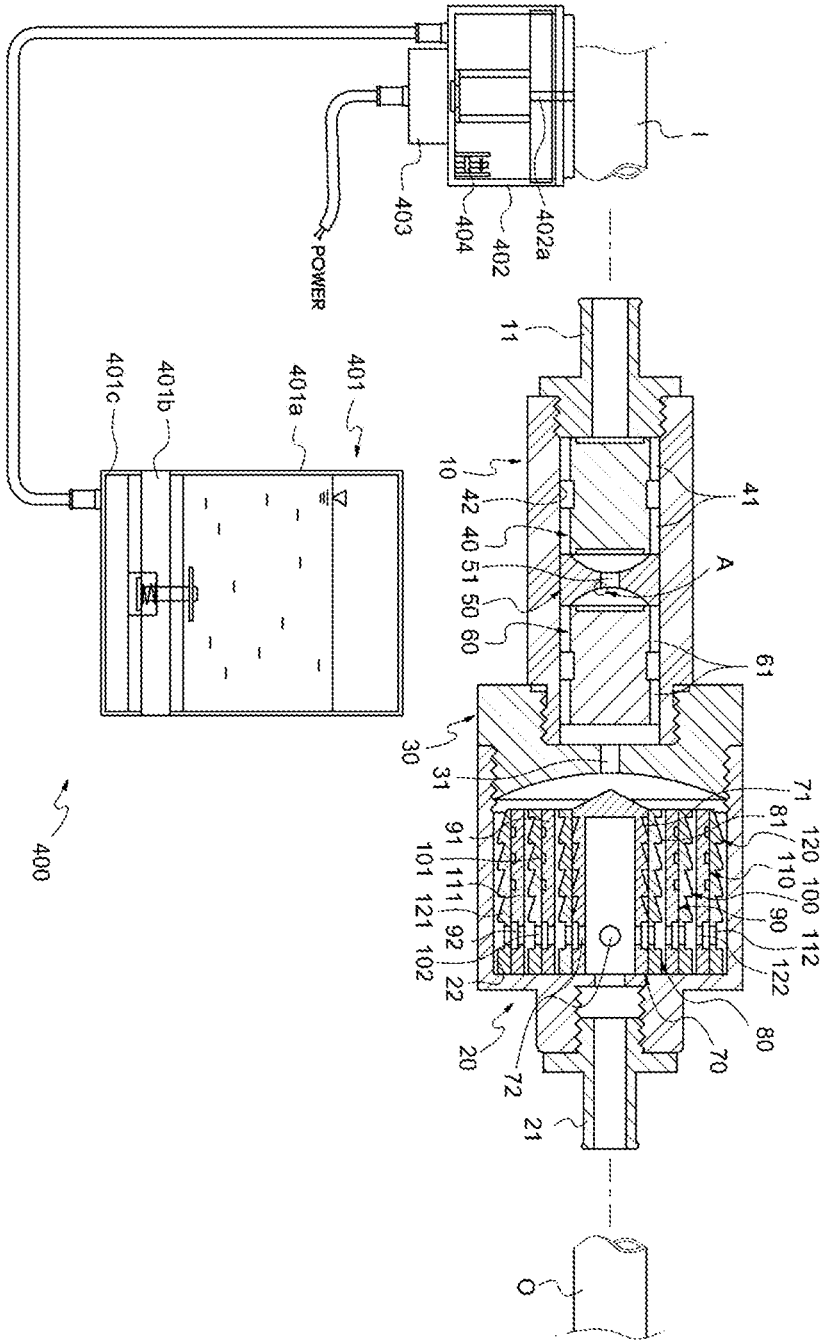
FIG. 12 is a cross sectional view illustrating an environmentally friendly fuel activation device with an atomized foam generator according to another embodiment of the present invention.
Figure 13:
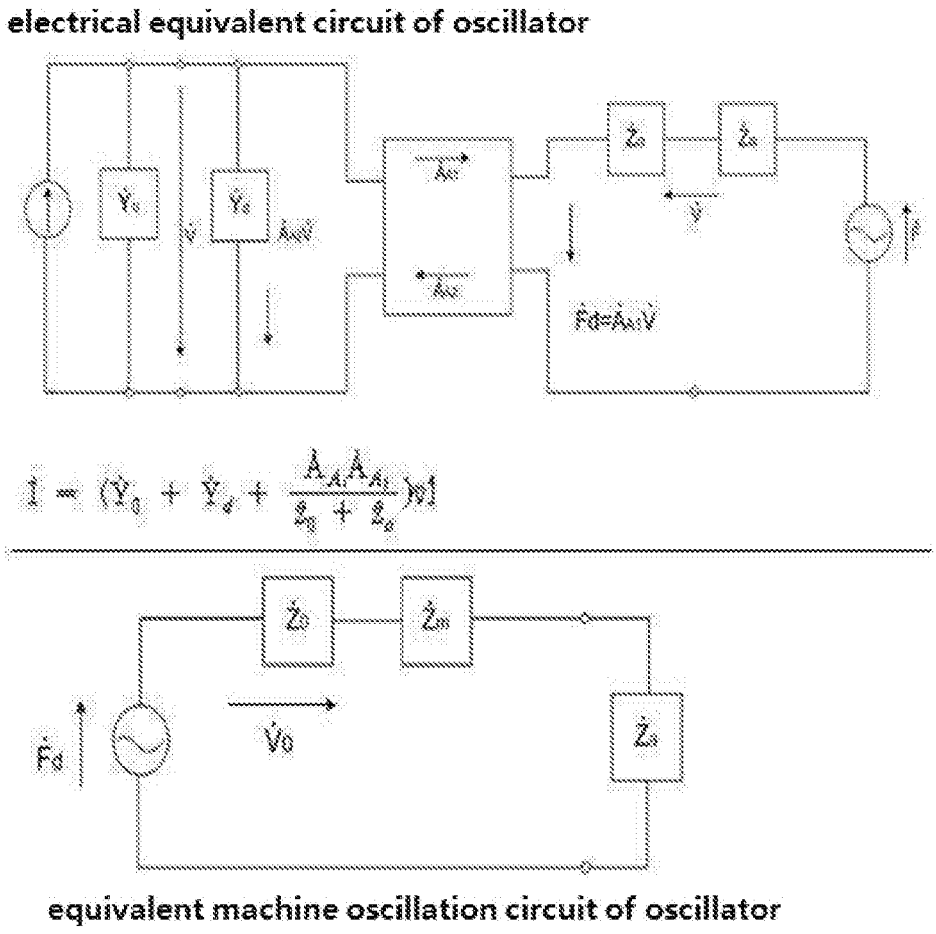
FIG. 13 is a circuit diagram of an electric equivalent circuit and an equivalent machine vibration circuit of an oscillator belonging to an atomized foam generator.
Figure 14:
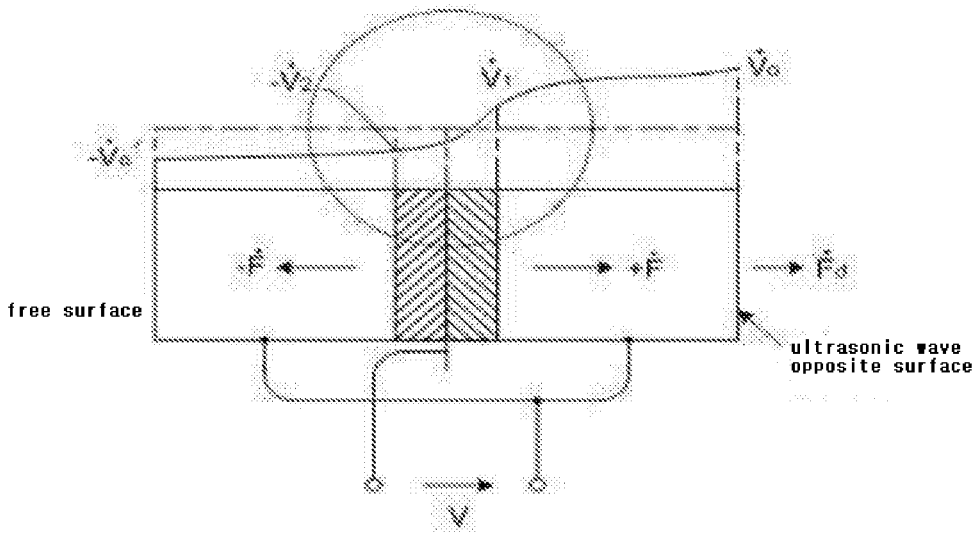
FIG. 14 is a view illustrating a driving force of an oscillator belonging to an atomized foam generator.

As shown in FIGS. 12, 13 and 14, the environmentally friendly fuel activation device according to the present invention comprises a first case 10, a second case 20, a connector 30 and an atomized foam generator 400, and a first rotation atomization part 40, acceleration parts 50 and 50' and a second rotation atomization part 60 which are installed in the interior of the first case 10, and a first rotation atomization tube 70, a first no-rotation atomization tube 80, a second rotation atomization tube 90, a second no-rotation atomization tube 100, a third rotation atomization tube 110 and a third no-rotation atomization tube 120 which are installed in the interior of the second case 20, and an atomized foam generator 400 which is attached to the supply fuel tube I.

The first case 10 is formed of a fuel inlet 11 connected to the supply fuel tube I, a hollow part 12, and fuel cohesive force attenuation means 13, 14, 15 and 16.

The second rotation atomization tube 60 is installed in close contact with the acceleration part 50 and has a spiral groove 61 longitudinally formed along an outer circumferential surface in a direction opposite to the spiral groove 41.

The second rotation atomization part 60 and the first rotation atomization part 40 are formed with their spiral grooves 61 and 41 being opposite, so they rotate in opposite directions by the flowing force of the fuel, thus rotation-atomizing and spraying the fuel.

The first rotation atomization tube 70 opens and closes the spray holes 31 of the connector 30 and is formed of a spiral rotation protrusion 71 formed along on an outer circumferential surface in a rotation direction, and a fuel inlet hole 72 formed at its own upper side for receiving fuel.

Here, the first rotation atomization tube 70 serves to open the spray holes 70 with the aid of the spray force generated as the fuel atomized by means of the rotation of the first rotation atomization part 40 and the second rotation atomization part 60 installed in the interior of the first case 10 is sprayed through the spray holes 31 of the connector 30, and serves to close the same when the spray force of the fuel is eliminated.

The first no-rotation atomization tube 80 is arranged surrounding the first rotation atomization tube 70 at the hollow part 22 of the second case 20, and has a straight rotation protrusion 81 at an outer circumferential surface in a rotation direction, and has a fuel inlet hole 82 at its own upper side for receiving fuel in such way to communicate with the fuel inlet hole 72 of the first rotation atomization tube 70.

The second rotation atomization tube 90 is arranged surrounding the first no-rotation atomization tube 80 and has a spiral rotation protrusion 91 on its own outer surface in a rotation direction and has a fuel inlet hole 92 at its own outer side for receiving fuel in such a way to communicate with the fuel inlet hole 72 of the first rotation atomization tube 70, and the fuel inlet hole 82 of the first no-rotation atomization tube 80.

The second no-rotation atomization tube 100 is arranged surrounding the second rotation atomization tube 90 and has a straight rotation protrusion 101 at its own outer circumferential surface in a rotation direction, and has a fuel inlet hole 102 at its own upper side for receiving fuel in such a way to communicate with the fuel inlet hole 72 of the first rotation atomization tube 70, the fuel inlet hole 82 of the first no-rotation atomization tube 80 and the fuel inlet hole 92 of the second rotation atomization tube 90, respectively.

The third rotation atomization tube 110 is arranged surrounding the second no-rotation atomization tube 100 and has a spiral rotation protrusion 111 at its own outer circumferential surface in a rotation direction and has a fuel inlet hole 112 at its own upper side for receiving fuel in such a way to communicate with the fuel inlet hole 72 of the first rotation atomization tube 70, the fuel inlet hole 82 of the first no-rotation atomization tube 80, the fuel inlet hole 92 of the second rotation atomization tube 90, and the fuel inlet hole 102 of the second no-rotation atomization tube 100, respectively.

The third no-rotation atomization tube 120 is arranged surrounding the third rotation atomization tube 110, and has a straight rotation protrusion 121 at its outer circumferential surface in a rotation direction and has a fuel inlet hole 122 at its own upper side in such a way to communicate with a fuel inlet hole 72 of the first rotation atomization tube 70, the fuel inlet hole 82 of the first no-rotation atomization tube 80, the fuel inlet hole 92 of the second rotation atomization tube 90, the fuel inlet hole 102 of the second no-rotation atomization tube 100, and the fuel inlet hole 112 of the third rotation atomization tube 110, respectively.

The atomized foam generator 400 comprises a water tank 401 for supplying water, a body 402 for receiving and storing water and having a spray hole 402*a* so that the foams atomized by means of ultrasonic wave can be inputted into the spray hole I' of the supply fuel tube I, an ultrasonic wave generator 403 for radiating ultrasonic waves to the water supplied from the lower side of the body 402, and a float switch 404 which is installed at one side of the body 402 and controls the operations of the ultrasonic wave generator 403.

The water tank 401 is formed of a water container body 401*a* for storing water, a water container lid 401*b* for opening and closing the water container body 401*a*, and a water container rest 401*c* for covering the water container lid 401*b*.

While the moisture particles atomized by means of the atomized foam generator 400 is mixed with the fuel supplied through the supply fuel tube I, the fuel is rotated and atomized by means of the first rotation atomization par 40 and the second rotation atomization part 60, the fuel is fully mixed while it passes through the second case 20 when the fuel flows and is inputted into the second case 20 through the spray hole 31 of the connector 30.

As shown in FIGS. 13 and 14, the atomized foam generator 400 might be formed of an electrical equivalent circuit or a mechanical equivalent circuit and is so configured that the free surface not affected by means of the ultrasonic wave generator 403 and the water affected by the same become same as in the ratio of the opposite surface where the water starts cavitation.

It is preferred that the oscillator driving force of the ultrasonic wave generator 403 is characterized in that the ratio between the fee surface which does not receive ultrasonic waves and the opposite surface where receives the ultrasonic waves and where water is atomized is 1:1.

The mixture ratio of fuel and atomized water is fuel:water=85%:15%. The mixing is performed based on an ultrasonic cavitation. A high temperature and pressure impact wave generally is generated when the temperature and pressure in the interior of the cavitation holes are very high, and the foams grow and explode, the mixture is accelerated with the aid of high level energy sources obtained during the above processes.

The operation of another embodiment of the present invention will be described.

As shown in FIGS. 12, 13 and 14, the first rotation atomization part 40, the acceleration part 50 and the second rotation atomization part 60 are sequentially installed in the interior of the first case 10, with the installation directions of the spiral grooves 41 and 61 of the first and second rotation atomization tubes 40 and 60 being opposite to each other.

In the event that the acceleration part 50' is installed, the first rotation atomization part 40 is inserted and inserted at the side of the fuel inlet part 11 about the acceleration part end 52', and the second rotation atomization part 60 is installed at the opposite side, with the installation directions of the spiral grooves 41 and 61 of the first and second rotation atomization tubes 40 and 60 being opposite each other.

The connector 30 is coupled to the first case 10, and then the first no-rotation atomization tube 80, the second rotation atomization tube 90, the second no-rotation atomization tube 100, the third rotation atomization tube 110, and the third no-rotation atomization tube 120 are sequentially installed in the interior of the second case 20 in a form of surrounding the same. Here, the above construction is so installed that the first rotation atomization tube 70 can open and close the spray holes 31 of the connector 30, and then the connector 30 and the second case 20 are coupled, thus finishing the assembly of the fuel activation device.

The fuel activation device according to the present invention is characterized in that the fuel inlet part 11 of the first case 10 is connected to the supply fuel tube I connected to the side of the fuel tank and the fuel supply device, and the second case 20 is connected to the exhaust fuel tube O connected to the side of the engine.

The finished fuel activation device is characterized in that when the fuel is supplied from the fuel supply device, the cohesive force of the fuel is attenuated by means of the cohesive force attenuation means 13, 14, 15 and 16 of the fuel of the first case 10, so the fuel is supplied in a form of atomization.

Here the cohesive force attenuation means 13, 14, 15 and 16 might be implemented in various forms, so applications can be selected depending on the state of fuels, thus enhancing the universal applications when in use.

When the fuel the cohesive force of which is attenuated is inputted into the interior of the first case 10, the first rotation atomization part 40 starts rotating at a high speed, thus atomizing the fuel, and the atomized fuel moves through the spray holes 51 and 51' of the acceleration parts 50 and 50', thus rotating the second rotation atomization part 60 in the reverse direction, which results in more powerful atomization.

In the event that the fuel is a liquid fuel such as gasoline, light oil, kerosene, bunker-c oil, etc., differential pressures occur by means of the ventilation holes 52 and 53', so a condensation phenomenon at the front surface where the fuel of the acceleration part 50 comes into and the front surface where the fuel of the acceleration part end 52' formed at the acceleration part 50' can be prevented, thus assuring a smooth flow of fuel.

The fuel which was atomized with a high speed rotation passing through the second rotation atomization part 60 fast moves into the interior of the second case 20 through the sprat holes 31 of the connector 30.

The atomized foam generator 400 keeps the float switch 404 turned on, and when the water from the water tank 401 is supplied to the body 402, the water vibrates by means of ultrasonic waves generated by the ultrasonic wave generator 403, and the atomized water particles are inputted into the interior of the body 402, and the filled water particles move along the spray holes 402*a*, and are mixed with the fuel which moves along the spray holes I' of the supply fuel tube I.

When the atomized moisture particles are mixed with the fuel at a certain ratio, it is appreciated that the combustion efficiency of the fuel increases.

The fuel mixed with the atomized water while passing through the first case 10 passes through the spray holes 31 and is inputted into the interior of the second case 20.

In the first rotation atomization tube 70, the spray holes 31 are fully opened by means of the spray force of the fuel, and at the same time the fuel mixed with water moves along the spiral rotation protrusion 71 of the first rotation atomization tube 70, thus rotating the first rotation atomization tube 70, and the first no-rotation atomization tube 80 moves along the straight rotation protrusion 81, and the first no-rotation atomization tube 80 does not rotate, and the second rotation atomization tube 90 moves along the spiral rotation protrusion 91, and the second rotation atomization tube 90 rotates, and the second no-rotation atomization tube 100 moves along the straight rotation protrusion 101, and the second no-rotation atomization tube 100 does not rotate, and the third rotation atomization tube 110 moves along the spiral rotation protrusion 111, and the third rotation atomization tube 110 rotates, and the third no-rotation atomization tube 120 moves along the straight rotation protrusion 121, and the third no-rotation atomization tube 120 does not rotate, through the processes of which the fuel is rotated and atomized, thus further atomizing the fuel, which results in increasing the contents of oxygen in the fuel.

While the atomized fuel randomly passes through the fuel inlet holes 72, 82, 92, 102, 112 and 122 of the first rotation atomization tube 70, the first no-rotation atomization tube 80, the second rotation atomization tube 90, the second no-rotation atomization tube 100, the third rotation atomization tube 110, the third no-rotation atomization tube 120, the dispersion and filtering the fuel, the collision and turbulence, the first turbulence, the collision and turbulence, the second turbulence, the collision, the third turbulence, and the dispersion are repeatedly performed in the course that the fuel is supplied to the engine through the exhaust fuel tube O through the fuel exhaust port 21 of the second case 20, so that the kinetic energy of the fuel is maximized, and the fuel is fully mixed with oxygen, thus consequently obtaining perfect combustions.

The right angle portions of the first and second cases 10 and 20 are made sloped, which minimizes the decrease of the fluidity of fuel flowing at a high speed, and the right angle portions can be prevented from damaging owing to the fuel flowing at a high speed.

INDUSTRIAL APPLICABILITY (First Embodiment)

The following table 1 represents a test condition, and table 2 shows a test result value following the evaluation test on a fuel and exhaust decrease performance by coupling a fuel activation device at a burner or an engine.

TABLE 1

| Classification | Before fuel activation device is installed | After fuel activation device is installed | Remarks |
|---|---|---|---|
| Number of tests | Three times | Three times | Reliable 500 km operations |

(here, the vehicle was Avante, and HC, $NO_x$, CO, fuel efficiency, etc. were tested in terms of the test measurements, and the test facilities were related facilities such as a chassis driving force meter, a vehicle exhaust analysis equipment, a particle phase substance measurement equipment, an exhaust analysis monitoring equipment, an air conditioning facility, and other measurement facilities.)

As result, as shown in Table 2, in the event that the system is operated following the engagement of the fuel activation device according to the present invention, it was confirmed that the contents of non-methane hydrocarbon, nitrogen oxide, carbon monoxide, etc.

It was confirmed that the fuel efficiency was slightly increased as compared to before the device of the present invention is installed. It was confirmed that as a result of the test, the air pollution substances were decreased, and the fuel efficiency was increased in such a way that the fuel was atomized, and the ratio of mixing with oxygen was increased.

TABLE 2

| | exhaust gas (g/km) | | | |
|---|---|---|---|---|
| classification | non-methane hydrocarbon (NMHC) | nitrogen oxide (NOx) | carbon monoxide (CO) | fuel efficiency (km/l) |
| 1st trial before fuel activation device is engaged | 0.202 | 0.311 | 1.750 | 12.4 |
| 2nd trial before fuel activation device is engaged | 0.199 | 0.337 | 1.927 | 12.6 |
| 3rd trial before fuel activation device is engaged | 0.180 | 0.347 | 1.621 | 12.3 |
| average | 0.1937 | 0.3317 | 1.7660 | 12.46 |
| 1st trial after fuel activation device is engaged | 0.196 | 0.251 | 1.641 | 12.8 |
| 2nd trial after fuel activation device is engaged | 0.181 | 0.267 | 1.468 | 12.9 |
| 3rd trial after fuel activation device is engaged | 0.185 | 0.282 | 1.527 | 12.9 |
| average | 0.1873 | 0.2667 | 1.5453 | 12.86 |
| change ratio(%) | −3.3 | 019.6 | −12.5 | 3.2 |

Consequently, as shown in Table 2, in the event that the fuel activation device of the present invention was installed, it was confirmed that the contents of non-methane hydrocarbon, nitrogen oxide, and carbon monoxide decreased.

In addition, it was confirmed that the fuel efficiency is slightly improved as compared to before the fuel activation device of the present invention was installed. So, as a result of the tests, it was confirmed that the contents of the air pollutants were decreased, and fuel efficiency were enhanced in such a way that the fuel was atomized, and the mixture with oxygen was increased, thus obtaining a perfect combustion.

Sequence List Free Texts cohesive force, attenuation means, acceleration part, rotation atomization tube, no-rotation atomization tube

The invention claimed is:

1. An environmentally friendly fuel activation device, comprising:

a supply tube (I) which receives an emulsified fuel through a water supply tube (200) coupled to a first valve (201) and a fuel supply tube (300) coupled to a second valve (301);

a first case (10) which has a fuel inlet part (11) coupled to the supply tube (I), a first hollow part (12) and fuel cohesive force attenuation means;

a second case (20) which has a fuel exhaust part (21) coupled to an exhaust fuel tube (O) and a second hollow part (22);

a connector (30) which connects the first case (10) and the second case (20) and has a first spray hole (31) at its central portion;

a first rotation atomization part (40) which is arranged close to the fuel inlet part (11) of the first case (10) and has a first spiral groove (41) at its outer circumferential surface in a longitudinal direction;

a first and a second acceleration parts (50, 50') which are arranged close to the first rotation atomization part (40) and has a second spray hole (51) at its central portion;

a second rotation atomization part (60) which is arranged close to the first acceleration part (50) and has a second spiral groove (61) at its outer circumferential surface in a longitudinal direction in the direction opposite to the first spiral groove (41);

a first rotation atomization tube (70) which serves to open and close the first spray hole (31) of the connector (30) and has a first spiral rotation protrusion (71) at its outer circumferential surface in a rotation direction;

a first no-rotation atomization tube (80) which is arranged at a second hollow part (22) of the second case (20) and surrounds the first rotation atomization tube (70) and has a first straight rotation protrusion (81) at its outer circumferential surface in a rotation direction;

a second rotation atomization tube (90) which is arranged surrounding the first no-rotation atomization tube (80) and has a spiral rotation protrusion (91) at its outer circumferential surface in a rotation direction;

a second no-rotation atomization tube (100) which is arranged surrounding the second rotation atomization tube (90) and has a second straight rotation protrusion (101) at its outer circumferential surface in a rotation direction;

a third rotation atomization tube (110) which is arranged surrounding the second no-rotation atomization tube (100) and has a third spiral rotation protrusion (111) at its outer circumferential surface in a rotation direction; and a third no-rotation atomization tube (120) which is arranged surrounding the third rotation atomization tube (110) and has a third straight rotation protrusion (121) at its outer circumferential surface in a rotation direction, wherein said fuel cohesive force attenuation means of the first case (10) is characterized in that the emulsified fuel from the supply tube (I) lose its cohesive force by magnetic forces of magnets (15*a*) and rotating jet force of a spiral nozzle (15*b*) while the emulsified fuel passes through the center of the plurality of serially arranged magnets (15*a*), and is re-sprayed by the spiral nozzle (15*b*), wherein said second acceleration part (50') is detachably engaged to the first case (10), with the first and second rotation atomization parts (40, 60) being inserted into the opposite side about the acceleration part (52') where a third spray hole (51') is formed at the central portion, wherein a connection method of the fuel inlet part (11) and the supply tube (I) of the first case (10) and the fuel exhaust part (21) and the exhaust fuel tube (O) of the second case (20) is performed by an one-touch method, wherein an engaging structure of the one-touch method consists of a coupling (IO4) connected to the supply tube (I) and the exhaust fuel tube (O); a fixing unit (IO2) connected to an inner peripheral area of the coupling (I04); a stopper (IO1) disposed inside the coupling (I04) by the fixing unit (IO2) to support its end when the fuel inlet part (11) and the fuel exhaust part (21) enter; and a driving part (IO3) disposed between the stopper (IO1), the fuel inlet part (11), and the fuel exhaust part (21) to disengage ends of the fuel inlet part (11) and the fuel exhaust part (21) from the stopper (IO1), wherein the first and the second hollow parts (12, 22) of the first and the second cases (10, 20) are formed in such a way that the right angle portions directly contacting with fuel are formed with a slope, thus preventing turbulence of fuel, whereby to prevent the decrease of flow performance and damages, and wherein edge angles of the second and the third spray holes (51, 51') of the first and the second acceleration parts (50, 50') are in a range of 30~45°, thus substantially preventing the occurrence of turbulences.

* * * * *